US006835142B1

(12) United States Patent
Levosinski

(10) Patent No.: US 6,835,142 B1
(45) Date of Patent: Dec. 28, 2004

(54) GOLF CLUB HEAD FOR TRAINING TO IMPROVE A USER'S SWING

(76) Inventor: George Levosinski, 142 Eagle Ridge Rd., Lake Orion, MI (US) 48360

( * ) Notice: Subject to any disclaimer, the term of this patent is extended or adjusted under 35 U.S.C. 154(b) by 0 days.

(21) Appl. No.: 09/456,772

(22) Filed: Dec. 8, 1999

(51) Int. Cl.[7] ..... A63B 69/36; A63B 53/04; A63B 53/08

(52) U.S. Cl. ..... 473/282; 473/324; 473/131; 473/282

(58) Field of Search ..... 473/345, 346, 473/349, 324, 131, 226, 219, 242; 228/107; A63B 53/04, 53/06, 53/08

(56) References Cited

U.S. PATENT DOCUMENTS 4,170,357 A * 10/1979 Greer ..... 273/167 R 5,522,594 A * 6/1996 Taylor et al. ..... 473/131

* cited by examiner

*Primary Examiner*—Glenn Caldarola
*Assistant Examiner*—Thanh Duong
(74) *Attorney, Agent, or Firm*—John R. Benefiel

(57) ABSTRACT

The device according to the invention uses the chemical energy stored in an explosive charge to increase the speed of a golf ball at impact with a golf club head. The device serves also as a training tool for the golf swing precision since the charge is set off only when the golfer hits the "sweet spot" on the club's head. Otherwise, the golfer experiences a regular swing. A golf club head has a cavity accepting a .22 caliber blank. The blank charge is set off upon impact with the golf ball. The high pressure of the gas thus released causes the golf club to propel the golf ball farther and faster than the regular golf club impact. Furthermore, since the discharge creates a loud "bang", this sound confirms that the hit was perfect.

3 Claims, 3 Drawing Sheets

GOLF CLUB HEAD FOR TRAINING TO IMPROVE A USER'S SWING

BACKGROUND OF THE INVENTION

This invention concerns golf training devices used to perfect a user's swing.

The use of special clubs for this purpose has heretofore been proposed, as for example the club described in U.S. Pat. No. 5,174,577.

Heretofore, there has not been proposed a training golf club design which provides a distinct indication that a correct swing has been executed, such that the user may improve his or her swing.

It is the object of the present invention to provide a golf swing training device which generates a pronounced and unmistakable indication when swing has been properly executed to provide an effective positive reinforcement to the user.

The object of this invention is to improve the golfer club swing precision by means of audible reinforcement when the perfect hit occurs. This happens only when the hit is perfect, which the golf ball contacts the club head at the "sweet spot" which is 12.5 mm in diameter.

SUMMARY OF THE INVENTION

The above recited object is achieved by using a small caliber blank cartridge to generate an explosive discharge of high pressure gas. The resulting sharp report provides a very satisfying positive feed back to the user indicating at least close to perfect swing has been executed.

A second advantage of this invention is an increase in the ball's velocity upon impacting the "sweet spot" on the club's head resulting in much increased travel of the golf ball.

An important reason for augmenting the golf ball speed is reduction of the golfer's sideways motion. As reported by the Investors Business Daily in April 1998: "Researchers from the Orthopaedic Research Laboratory and the Department of Orthopaedic Research Laboratory and the Department of Orthopaedic Surgery and Sports Medicine at Kawatetsu Hospital in Chiba, Japan, performed the study. They found that sideways tilting of the body during the swing contributed to low back pain. "We believe that the sideways motion combined with an increase in twisting speed (of the upper body) while swinging the golf club can cause low back pain, Banks said." The power assisted golf club would require less swing. The golfer can achieve the same distance as before with less twist and less pain, and will enable golfers with physical impairment to play the game.

FIGURES IN THE DRAWINGS

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed in as much as the invention is capable of taking many forms and variations within the scope of the appended claims.

Figure 1:
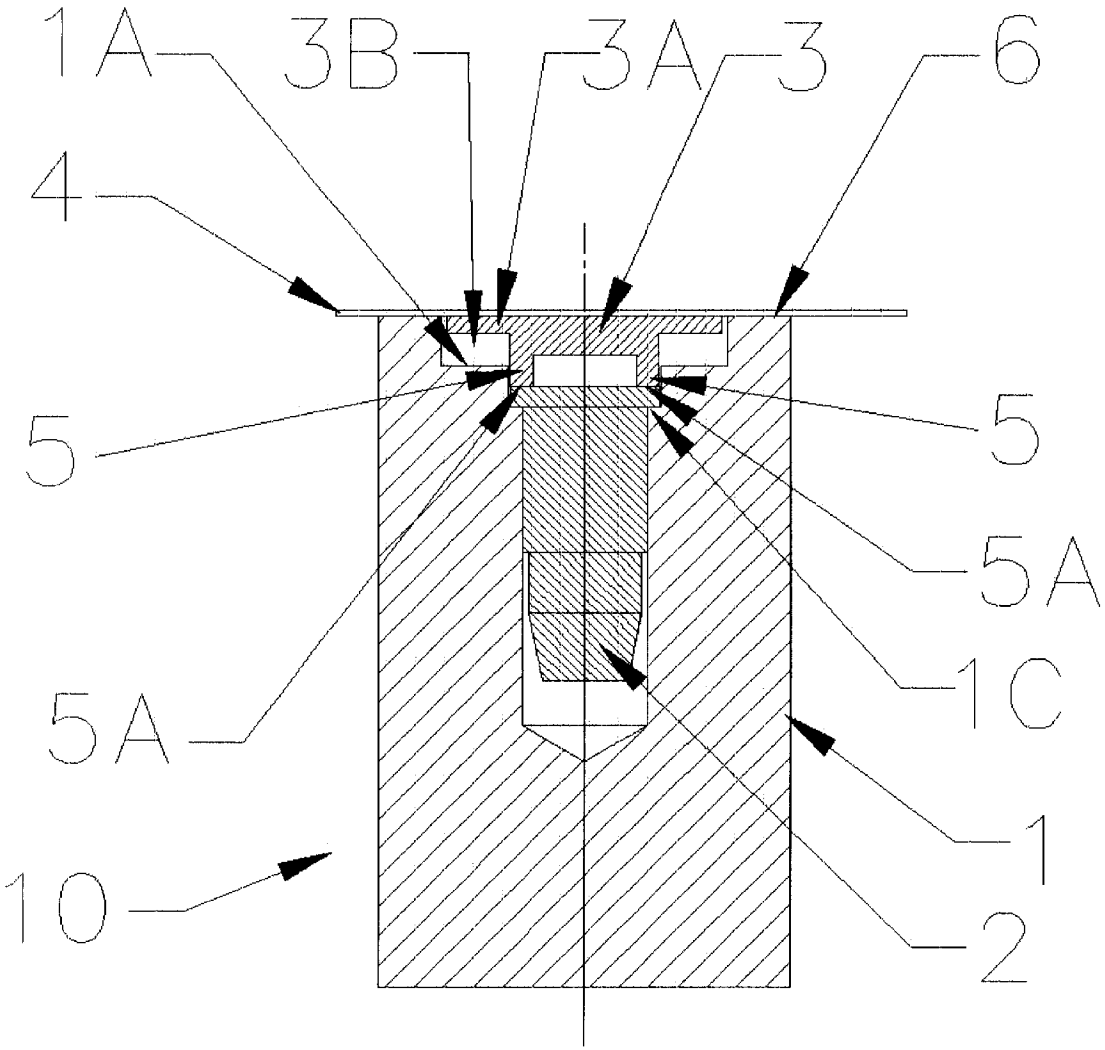
FIG. 1 is a sectional view of a gas chamber insert for a golf club head according to the present invention revealing its interior structure.

Referring to FIG. 1, an insert assembly 10 for a golf club head according to the invention has a closed end pressure chamber 1, designed to accept an explosive charge, such as, for example, a .22 caliber rim fire blank cartridge 2. The rim of the .22 cartridge is positioned against a shoulder 1C of the bore forming the chamber 1. The pressure chamber 1 has an additional stepped recess 1A accepting an ignition cap 3. The recess 1A extends into the 1 pressure chamber 1 from a striking face 6 of the insert 10. The cap 3 is releasably held in position in the recess 1A solely by a piece of adhesive tape 4 extending across a wide flange 3A on the outer end of the cap 3. The tape 4 is attached to the striking face 6, of the insert 10 extending across the flange 3A of the cap 3.

The cartridge 2 is discharged when the ball strikes the ignition cap 3 when the user executes a perfect swing such that the "sweet spot" at which the cap 3 is located meets the ball. Two pins 5, protruding from the inside face of the cap 3 have end faces 5A which are driven into the cartridge rim and cause it to fire, generating the gas pressure. Such slight movement is accommodated by a clearance 3B and the "give" inherent in the piece of tape 4. The loud sound created by discharge of the blank cartridge 2 provides a pronounced and satisfying signal that a perfect swing has been executed.

The gas pressure being otherwise confined, in turn also drives the cap 3 out of the recess 1A in which it is releasably held by the piece of adhesive tape 4 to strike the ball, thereby augmenting the force on the golf ball generated by the impact of the swinging club.

Figure 2:
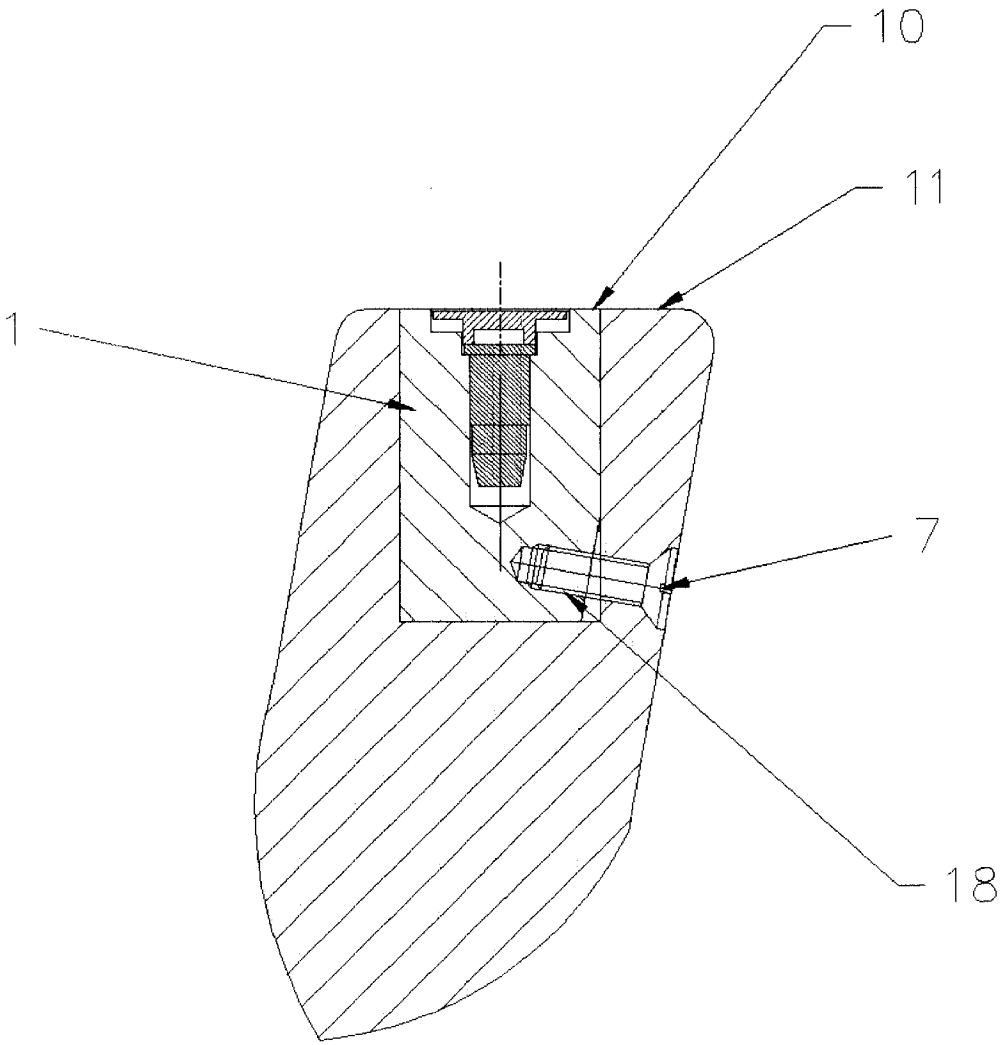
FIG. 2 is a sectional view of a club head showing an installation of the gas chamber into a golf wood club head.

Referring to FIG. 2, the pressure chamber insert 1 has a threaded hole 18, which is used to hold the pressure chamber insert 1 in place in a hole drilled into the striking face 11 of a golf club head 12 by means of a set screw 7.

Figure 3:
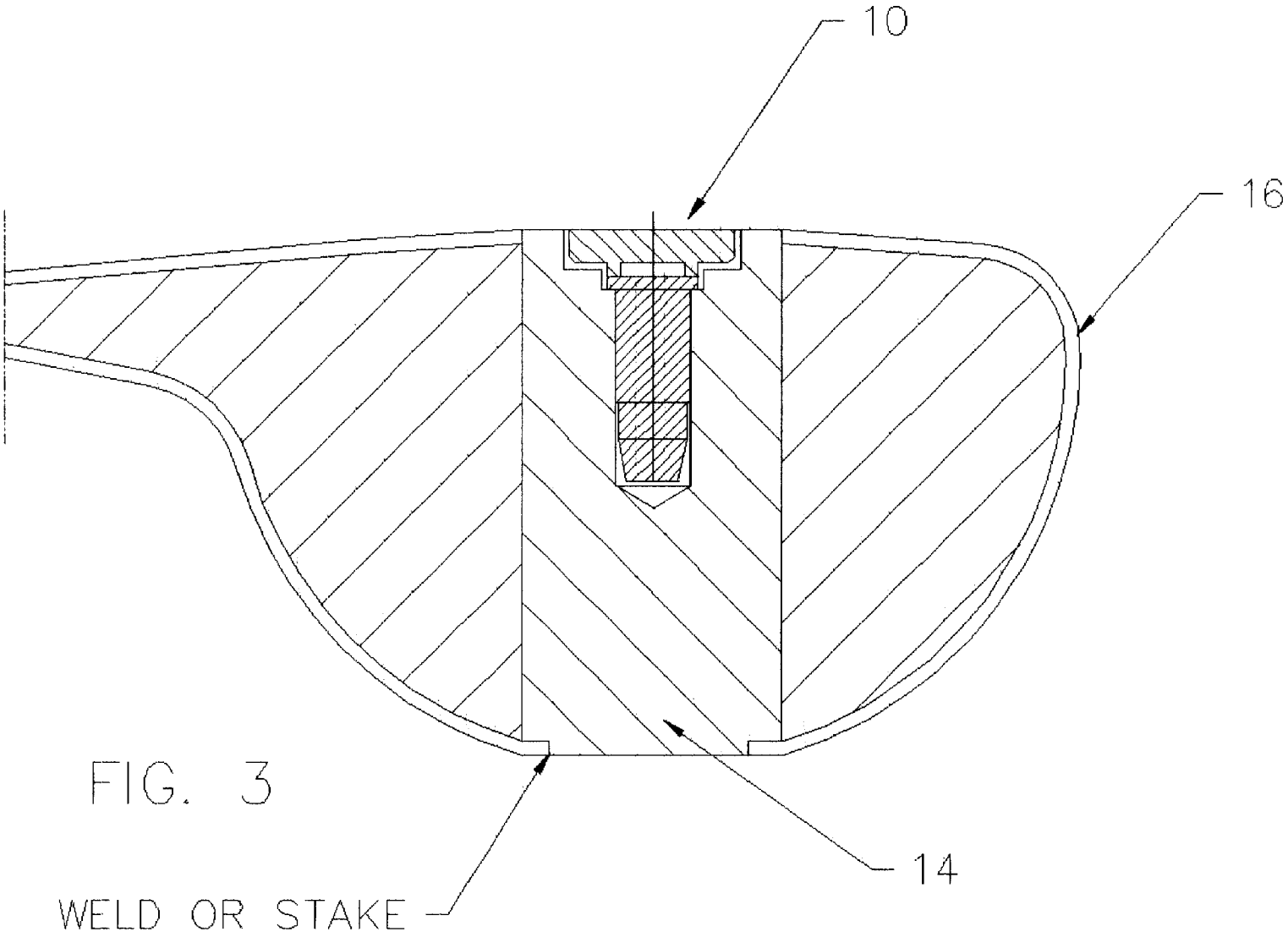
FIG. 3 is a sectional view through a club head showing installation of the gas chamber into a metal club head by means of welded joint or by a staking operation.

Referring to FIG. 3, the pressure chamber insert 10 can alternatively be installed in a metal plug 14, in turn welded to the walls of a metal golf club head 16 by means of laser or MIG welding or by staking.

What is claimed is:

1. A golf club head comprising:

pressure chamber insert received into a bore extending into a striking face of said club head, said insert located at the sweet spot of said club head;

an explosive charge received within a closed end pressure chamber within said pressure chamber insert;

a firing cap fit into a recess extending into said pressure chamber in said pressure chamber insert and having an outer end positioned to be impacted by striking a golf ball at said sweet spot, said firing cap including a portion adapted to detonate said charge by compression thereof by said golf ball impact;

said firing cap being movable in said recess so as to accommodate slight inward movement sufficient to detonate said charge;

said firing cap also being releasably held in said recess so as to be propelled out of said pressure chamber insert upon detonation of said explosive charge to drive said golf ball and augment the driving force generated by impacting of said golf ball by said club head.

2. A golf club head according to claim 1 wherein said explosive charge is contained in a .22 caliber rimfire blank cartridge received in said pressure chamber with the rim thereof against a shoulder on said pressure chamber, and said firing cap portion compresses a rim of said cartridge against said shoulder to fire the main charge.

3. A golf club head according to claim 1, wherein said firing cap is held in said pressure chamber insert with a piece of adhesive tape.

* * * * *